US006161086A

United States Patent [19]

Mukherjee et al.

[11] Patent Number: 6,161,086

[45] Date of Patent: Dec. 12, 2000

[54] LOW-COMPLEXITY SPEECH CODING WITH BACKWARD AND INVERSE FILTERED TARGET MATCHING AND A TREE STRUCTURED MUTITAP ADAPTIVE CODEBOOK SEARCH

[75] Inventors: Debargha Mukherjee, Santa Barbara, Calif.; Erdal Paksoy, Richardson, Tex.

[73] Assignee: Texas Instruments Incorporated, Dallas, Tex.

[21] Appl. No.: 09/115,658

[22] Filed: Jul. 15, 1998

Related U.S. Application Data

[60] Provisional application No. 60/054,062, Jul. 29, 1997.

[51] Int. Cl.[7] ..... G10L 19/10

[52] U.S. Cl. ..... 704/207; 704/219; 704/222

[58] Field of Search ..... 704/207, 219, 704/222, 223; 382/253; 348/422

[56] References Cited

U.S. PATENT DOCUMENTS

| | | | |
|---|---|---|---|
| 5,323,486 | 6/1994 | Taniguchi et al. | 704/222 |
| 5,398,069 | 3/1995 | Huang et al. | 348/422 |
| 5,602,961 | 2/1997 | Kolesnik et al. | 704/223 |
| 5,649,030 | 7/1997 | Normile et al. | 382/253 |
| 5,677,986 | 10/1997 | Amada et al. | 704/222 |
| 5,701,392 | 12/1997 | Adoul et al. | 704/219 |
| 5,727,122 | 3/1998 | Hosoda et al. | 704/223 |
| 5,745,871 | 4/1998 | Chen | 704/207 |
| 5,822,465 | 10/1998 | Normile et al. | 382/253 |
| 6,014,618 | 1/2000 | Patel et al. | 704/207 |

*Primary Examiner*—David R. Hudspeth
*Assistant Examiner*—Susan Wieland
*Attorney, Agent, or Firm*—Wade James Brady, III; Frederick J. Telecky, Jr.

[57] ABSTRACT

A family of low-complexity, high quality CELP speech coders are described which use two new techniques: Backward and Inverse Filtered Target (BIFT) for fixed codebook excitation search; and Tree-Structured Multitap adaptive codebook search. Incorporation of these new techniques resulted in very low complexity CELP coders at less than 16 Kb/s. The three coefficients for linear combination of the adaptive codebook are chosen from a tree-structured tap codebook. The best tap index in the primary codebook points to a secondary codebook where the search is further conducted. This procedure may be repeated many times, wherein each subsequent tap codebook points to yet another subsequent tap codebook, which points to yet another subsequent tap codebook, etc. A fixed ternary excitation codebook using a new technique called Backward and Inverse Filtered Target matching (BIFT), is used to encode the portion of the target signal that is left behind after the adaptive codebook contribution has been subtracted. BIFT combines the elements of the Backward Filtered Target response and Inverse Filtered Target response by element-by-element multiplication to define a new vector. A predetermined number of maximums of the new vector are chosen as the pulse locations and the signs assigned are the same as the signs of the corresponding elements.

18 Claims, 3 Drawing Sheets

LOW-COMPLEXITY SPEECH CODING WITH BACKWARD AND INVERSE FILTERED TARGET MATCHING AND A TREE STRUCTURED MUTITAP ADAPTIVE CODEBOOK SEARCH

This application claims priority under 35 USC § 119 (e) (1) of provisional application No. 60/054,062 filed Jul. 29, 1997.

FIELD OF THE INVENTION

This invention relates in general to speech coding and in particular to Code-Excited Linear Prediction (CELP) speech coders.

BACKGROUND OF THE INVENTION

In speech recognition or speech synthesis systems, digital speech is generally sampled at the Nyquist sampling rate, 2 times the input signal bandwidth, or an 8 kHz sampling rate which results in 8,000 samplings a second. Therefore 128,000 bits/second are necessary to effect an 8 kHz sampling rate using 16 bits/sample. As can easily be seen, just 10 seconds worth of input digital speech can require over a million bits of data. Therefore, speech coding algorithms were developed as a means to reduce the number of bits required to model the input speech while still maintaining a good match with the input speech.

Code-Excited Linear Prediction (CELP) is a well known class of speech coding algorithms with good performance at low to medium bit rates (4 to 16 Kb/s). CELP coders typically use a 10th order LPC filter excited by the sum of adaptive and fixed excitation codevectors for speech synthesis. The input speech is divided into fixed length segments called frames for LPC analysis, and each frame is further divided into smaller fixed length segments called subframes for adaptive and fixed codebook excitation search. Much of the complexity of a CELP coder can be attributed to the adaptive and fixed codebook excitation search mechanisms.

As shown in FIG. 1, the CELP coder consists of an encoder/decoder pair. The encoder, as shown in FIG. 2, processes each frame of speech by computing a set of parameters which it codes and transmits to the decoder. The decoder, as shown in FIG. 3, receives the information and synthesizes an approximation to the input speech, called the coded speech. The parameters transmitted to the decoder consist of the Linear Prediction Coefficients (LPC), which specify a time-varying all-pole filter called the LPC synthesis filter, and excitation parameters specifying a time-domain waveform called the excitation signal. The excitation signal comprises the adaptive codebook excitation and the fixed (or pulsed) excitation, as shown in FIGS. 2 and 3. The decoder reconstructs the excitation signal and passes it through the LPC synthesis filter to obtain the coded speech.

The LPC prediction parameters, obtained by LPC analysis, are converted to log-area-ratios (LARs), and can be scalar quantized using, for example, 38 bits by the encoder. An example of the bit allocation for the 10 LARs is as follows: 5,5,4,4,4,4,3,3,3,3.

The excitation signal is a sum of two components obtained by two different codebooks, a multitap adaptive codebook and a fixed excitation codebook. A multitap adaptive codebook, with 3 taps, is employed to encode the pseudo-periodic pitch component of the linear prediction residual. An open-loop pitch prediction scheme is used to provide a pitch cue, in order to restrict the closed-loop multitap adaptive codebook search range to 8 lag levels around it. The adaptive codebook consists of a linear combination of 3 adjacent time-shifted versions of the past excitation. These 3 adjacent time-shifted versions of the past excitation are generally extremely complex to originate and require thousands of computations. In addition, the fixed excitation codebook search is generally a very complex operation when performed optimally. Codebook entries can also be selected by one of several sub-optimal process' which results in a distortion of the original speech signal achieving a trade-off between complexity and quality which is not suitable for some applications.

SUMMARY OF THE INVENTION

According to a first preferred embodiment of the invention, the three coefficients for linear combination of the adaptive codebook are chosen from a tree-structured tap codebook. The use of tree-structured tap codebooks reduces the requisite computations considerably. The encoder transmits both the best pitch lag, as well as the best tap-vector index to the decoder. The best tap vector index in the primary tap codebook points to a secondary tap codebook where the search is further conducted. Moreover the steps can be repeated wherein said secondary tap codebook becomes the new primary tap codebook and is used to develop a new secondary tap codebook, and said process is repeated a plurality of times until a satisfactory match between the synthetic speech and input signal is reached. According to a second preferred embodiment of the invention, a fixed ternary excitation codebook using a new technique called "backward and inverse filtered target" (BIFT) matching, is used to encode the portion of the target signal that is left behind after the adaptive codebook contribution has been subtracted. This codebook consists of codevectors containing only a small fixed number of non-zero samples, either +1 or −1, with one or more gains associated with them.

DETAILED DESCRIPTION OF THE PREFERRED EMBODIMENTS

Figure 1:
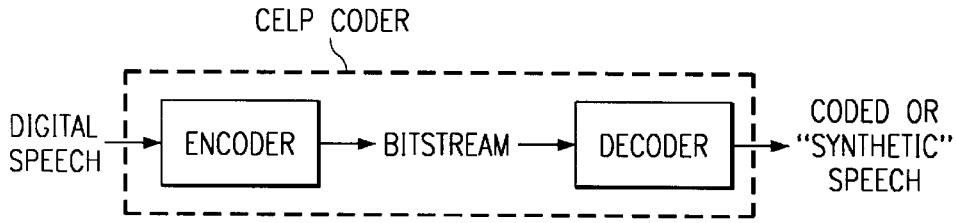
FIG. 1 (PRIOR ART)
FIG. 1 shows a high level block diagram of a typical speech coder.
Figure 2:
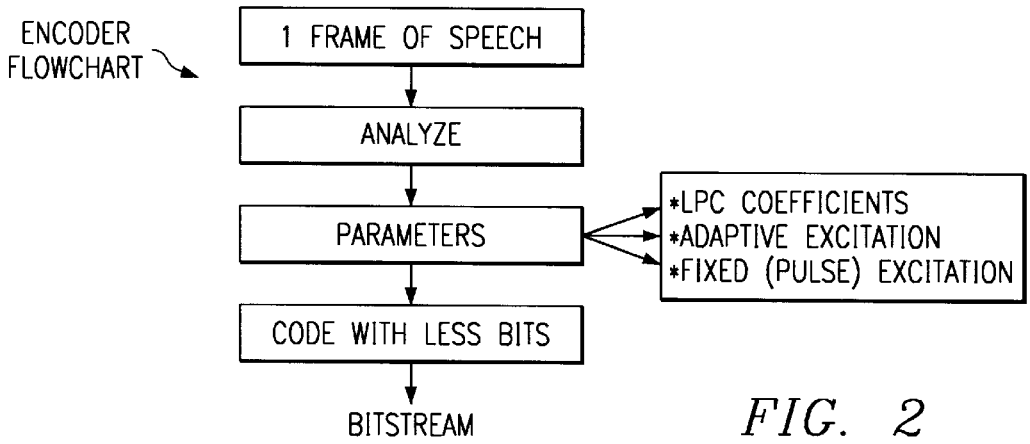
FIG. 2 (PRIOR ART)
FIG. 2 shows the flowchart of an encoder of a CELP coder.
Figure 3:
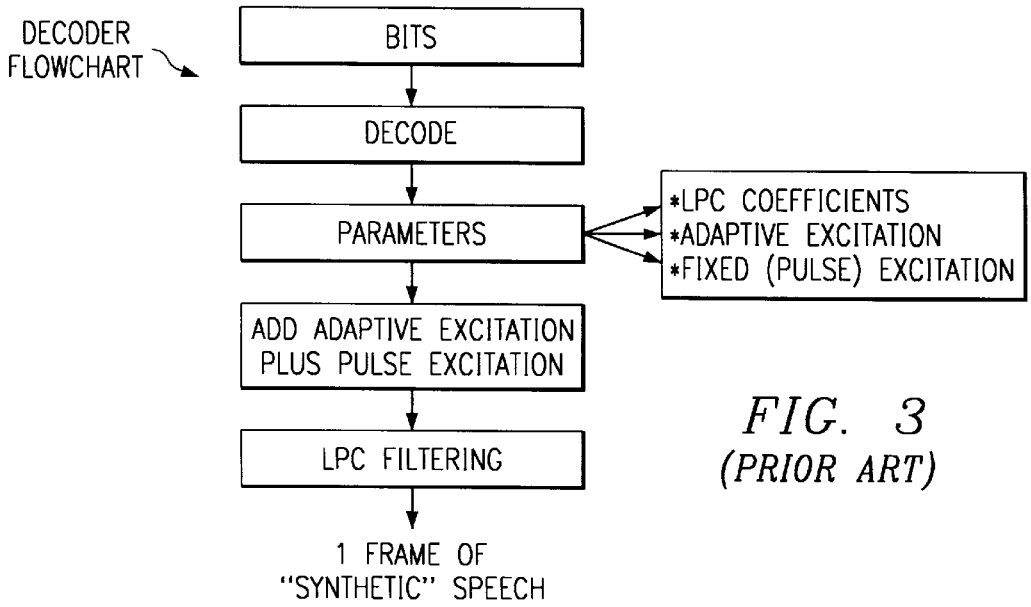
FIG. 3 (PRIOR ART)
FIG. 3 shows the flowchart of a decoder of a CELP coder.
Figure 4:
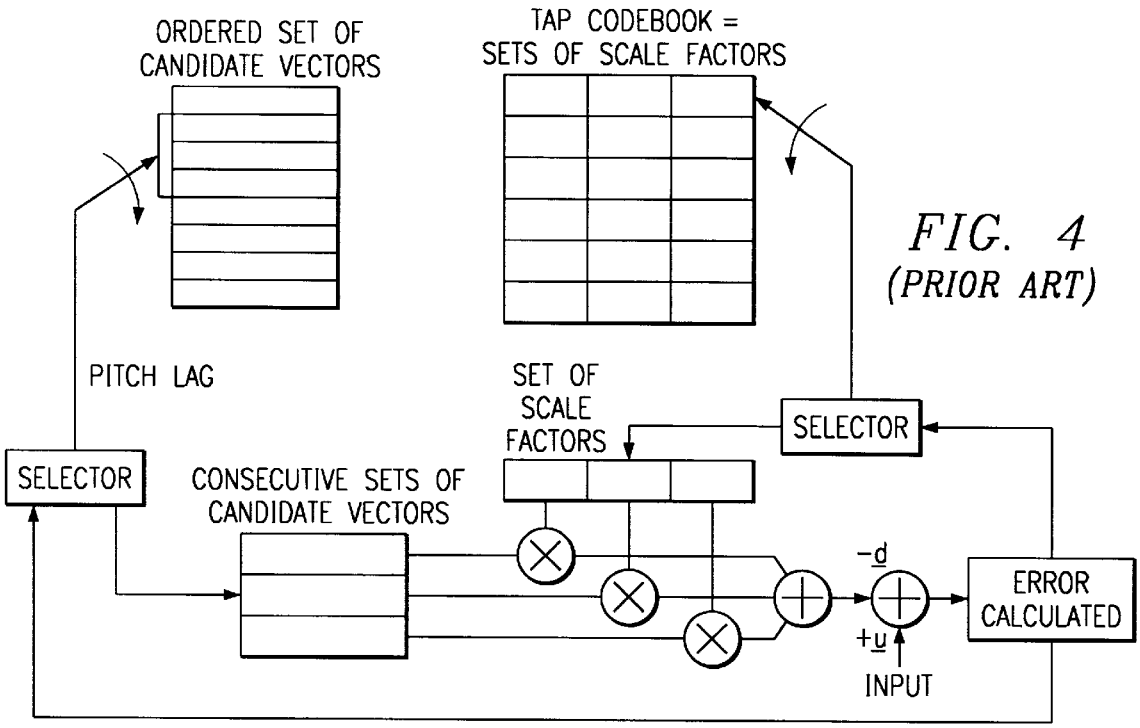
FIG. 4 (PRIOR ART)
FIG. 4 shows the encoding of input digital speech with multi-tap adaptive codebook search.

Use of Tree-Structured Multitap adaptive codebook excitation search and Backward and Inverse Filtered Target for fixed codebook excitation search, enable the development of a family of very low complexity CELP coders. FIG. 4 shows a sketch of a traditional adaptive codebook search. The box on the upper left is the codebook containing candidate vectors. A candidate vector is a set of past consecutive samples of the processed speech signal separated in time from the input vector by a number of samples called the candidate pitch lag. On the upper right, the tap codebook is shown. Entries in the tap codebook are sets of scale factors or gains. The error calculation box on the middle right controls the two selectors, which simply read a set of candidates and a tap vector into proper 'registers'. The contents of these registers are then appropriately combined with the multiply-accumulate block diagram in the middle. The best combination of taps and candidate vectors is the one that results in the smallest error between input u and the output d.

The general form of a multitap adaptive codebook excitation with 2q+1 taps is given as:

$$\underline{d} = \sum_{i=-q}^{q} b_i \underline{\hat{d}}_{m+i} \qquad \text{(EQ 1)}$$

where d is the current adaptive codebook excitation vector, $d_k$ is the adaptive codebook excitation shape vector at lag k, m is the pitch lag, and the $b_i$'s are the tap coefficients, commonly denoted by a vector $b=[b_{-q}, b_{-q+1}, \ldots, b_q]^T$.

Exhaustive joint search for the pitch lag m and the tap vector b from an unstructured codebook, that produce the best match with the target, makes the search a computationally expensive procedure, even if the range of lags considered in the search is restricted to the neighborhood of an initial pitch estimate. In order to reduce the complexity, the search could be performed in the residual domain rather than in the weighted speech domain. The algorithms used to perform the search in the residual domain are described fully in subsequent paragraphs.

Figure 5A:
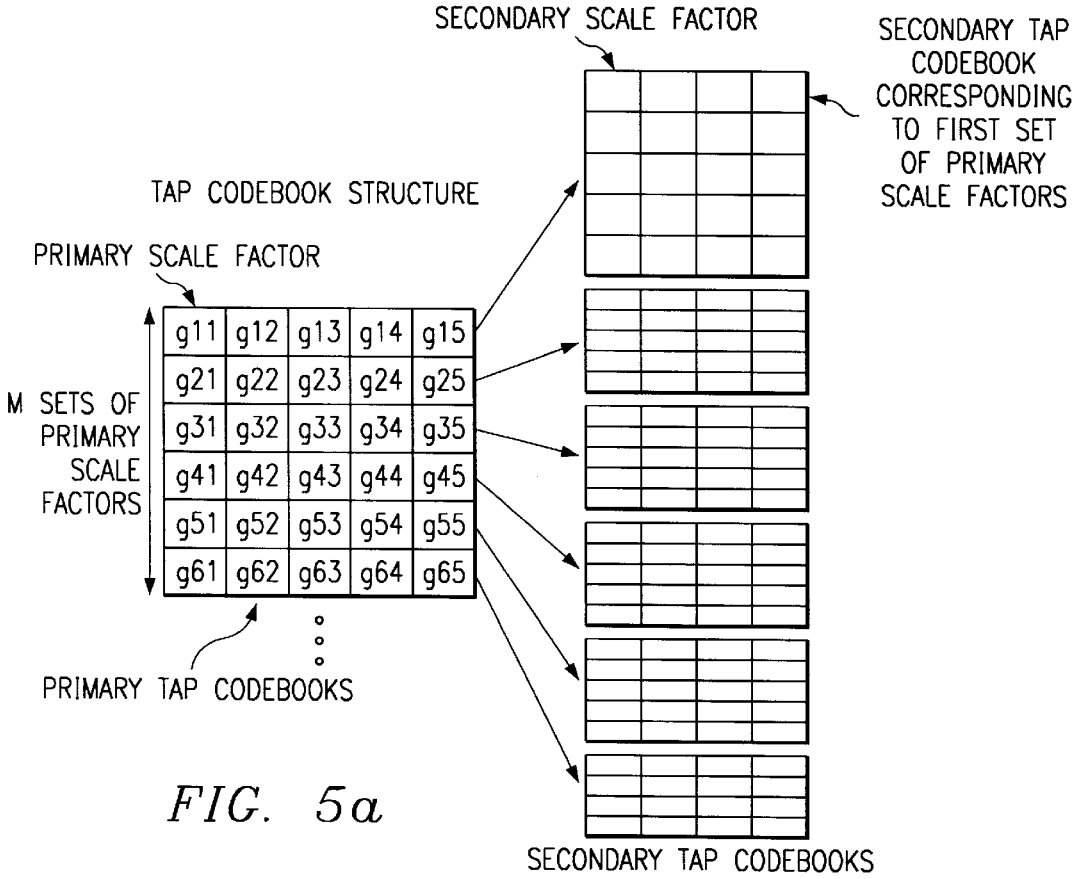
FIG. 5*a* shows the correspondence between and the structure of the primary and secondary tap codebooks of the tree-structured adaptive codebook search according to a first preferred embodiment of the invention.
Figure 5B:
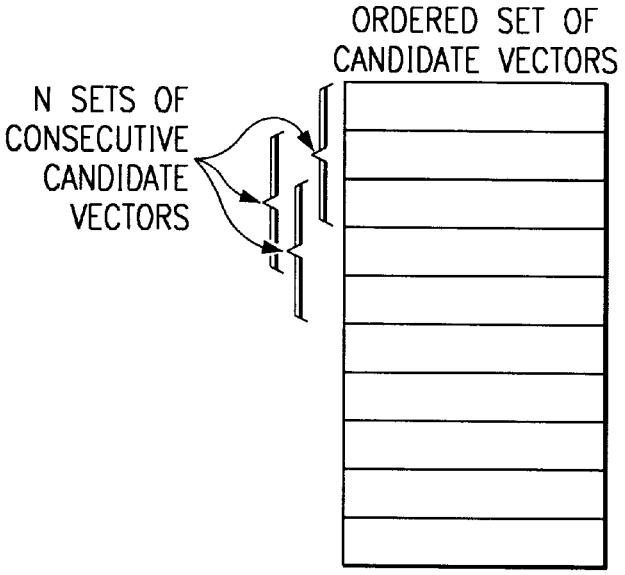
FIG. 5*b* shows the structure of ordered sets of consecutive candidate vectors and N sets of consecutive candidate vectors according to a first preferred embodiment of the invention.

For some applications, however, the complexity of the multitap search must be reduced even further. To achieve this, we propose to use a tree-structured tap codebook as shown in FIG. 5*a,* rather than an unstructured codebook as shown in FIG. 4, for performing the search for the best tap vector, in either the residual or the weighted speech domain. For each pitch lag we first compute the best tap vector in a small primary codebook. The best tap index in the primary codebook points to a secondary codebook where the final search is conducted, as shown in FIG. 5*a*. The resulting degradation in quality due to this sub-optimal search is tolerable when weighed against the gain in computational complexity. For example, if we decide on spending 5 bits for transmitting the tap index, we may first search for the best tap vector in a primary codebook of 8 levels, and then search in a secondary codebook of 4 levels that the best tap-vector in the primary codebook points to. This results in a drastic reduction in computations from the normal scheme where we would search a full 32-level tap codebook. More specifically, only 8+4=12 tap vectors now need to be searched for each pitch lag, rather than the usual 32, thereby reducing the complexity to 12/32 of that in the original method. The degradation in segmental SNR is only about 0.1–0.2 dB, and the reconstructed speech does not show any audible degradations at all.

A modification of the generalized Tree-Structured VQ design procedure with closed loop nearest neighbor and centroid conditions was implemented for both the unstructured and the tree-structured codebook design. The multitap adaptive codebook search design procedure begins with letting u be the weighted input speech, after the memory in the weighted synthesis filter has been subtracted from it (commonly referred to as the target). Also let H be the lower-triangular Toeplitz matrix formed from the impulse response of the perceptually weighted LPC synthesis filter. Note that perceptual weighting of speech signals in speech coding is well documented in literature. Also define the backward filtered target as $c=H^T$.

The multitap search scheme strives to minimize the distortion $D=|u-Hd|^2$ by searching jointly for the best pitch lag M, and the best tap coefficient vector from a tap codebook. If we use (EQ 1) to expand d in the expression above for any pitch lag m, we get an expression of the form, $$D=|u|^2-\zeta^T\beta,$$

Here, ζ is a correlation vector of the form ζ=[x y z], with row-vector $$x=[c^T\hat{d}_{m-q} c^T\hat{d}_{m-q+1} \ldots c^T\hat{d}_{m+q}]$$

having 2q+1 elements, row vector $$y=[|H\hat{d}_{m-q}|^2 |H\hat{d}_{m-q+1}|^2 |H\hat{d}_{m+q}|^2]$$

having 2q+1 elements, row vector $$z=[(H\hat{d}_{m-q})^T(H\hat{d}_{m-q+1})(H\hat{d}_{m-q})^T(H\hat{d}_{m-q+2}) \ldots (H\hat{d}_{m+q-1})^T(H\hat{d}_{m+q})]$$

having q(2q+1) elements. Note that ζ is of size (q+2)(2q+1). β is a vector derived from the tap coefficient vectors and has (q+2)(2q+1) elements. $\beta=[p\ q\ r]^T$, with row vector $p=[2b_{-q}\ 2b_{-q+1}\ 2b_q]$ having 2q+1 elements, row vector $q=[-b_{-q}^2-b_{-q+1}^2 \ldots -b_q^2]$ having 2q+1 elements, and row vector $r=[b_{-q}b_{-q+1}b_{-q}b_{-q+2} \ldots b_{q-1}b_q]$ having 2q+1 elements. Note that the β vectors can be pre-computed and stored for each tap codevector since they depend only on the tap coefficients.

Minimizing D is equivalent to maximizing $\zeta^T\beta$. The search process computes first the correlation vector ζ for each candidate pitch-lag. Then for each ζ thus computed, it searches for the β vector in the β-codebook that maximizes its inner product with ζ. The best combination of the pitch lag and the tap vector is transmitted. Note that it is possible to develop an efficient recursive implementation of the computation of the successive $Hd_k$'s, that are needed to compute the elements of ζ. Even with this recursive efficient search, an exhaustive joint search for the best lag m and the best tap vector b in an unstructured codebook makes the algorithm exceedingly complex.

In order to reduce the complexity of this algorithm, the search can be performed in the target excitation domain rather than in the target weighted-speech domain. Given the target u, a vector $u'=H^{-1}u$ is computed so that u' when filtered through H(z) produces u exactly. Then we attempt to minimize $D'=|u'-d|_2$, where d is given as in (EQ 1). If we use (EQ 1) to expand d in the expression above, we get an expression of the form, $$D'=|u'|^2-\zeta^T\beta, \qquad \text{(EQ 3)}$$

ζ is still a correlation vector of the form ζ=[x y z], but now row vector $$x=[u'^T\hat{d}_{m-q} u'^T\hat{d}_{m-q+1} \ldots u'^T\hat{d}_{m+q}].$$

having (2q+1) elements, row-vector $$y=[|\hat{d}_{m-q}|^2 |\hat{d}_{m-q+1}|^2 |\hat{d}_{m+q}|^2]$$

having (2q+1) elements, and row-vector $$z=[(d^{\hat{}}_{m-q}{}^{T}d^{\hat{}}_{m-q+1})(d^{\hat{}}_{m-q}{}^{T}d^{\hat{}}_{m-q+2})\ldots(d^{\hat{}}_{m+q-1}{}^{T}d^{\hat{}}_{m+q})]$$

having q(2q+1) elements. β is the same as before. The search process is almost the same as before except that we do not need the computations for the $Hd_k$'s anymore. As mentioned earlier, an exhaustive search for the best lag m and the best vector b from an unstructured codebook can still make this algorithm computationally expensive.

Alternatively, according to a preferred embodiment of the invention, the tree-structured tap codebook search combined with searching in the residual domain, produced a very efficient algorithm for adaptive codebook search that is incorporated into the unique low complexity CELP coder. For the design of the multitap codebooks, we follow a closed-loop scheme where a training speech file is repeatedly coded by the encoder, and the tap codebook is updated at the end of each pass. First, consider the case where an initial codebook is available. We encode the training speech using the same coder for which we want to generate the tap codebooks. The adaptive codebook search part of the coder uses the initial tap codebook for its multitap search. Assume $G_b$ to be the set of all ζ vectors, throughout the encoding operation, that were chosen as the best in conjunction with a particular tap vector b. That is, for any subframe during the encoding operation, a pitch lag M together with tap vector b, are chosen as the best for the corresponding target, then the ζ vector corresponding to the pitch M for that subframe will be an element of the set $G_b$.

The centroid condition for the design process must be such that the sum of the distortions (EQ 2–3) for all excitations using a particular tap vector b is minimized. If we assume that the corresponding u or u' vectors are independent of the b vectors, then the criterion reduces to maximizing the following metric:

$$E_b = \sum_{\underline{\zeta}\in G_b} \underline{\zeta}^T \underline{\beta} \qquad \text{(EQ 4)}$$

Maximizing $E_b$ with respect to the tap coefficients $b_k$'s of b, yields a system of linear equations of the form Ab=c where A is a (2q+1)-by-(2q+1) matrix, c is a (2q+1) vector, and the solution b is the (2q+1)-vector giving the best tap vector for the set $G_b$. If $\zeta=[x\ y\ z]^T$, as defined previously, with $x=[x_{-q},x_{-q+1},\ldots,x_q]$, $y=[y_{-q},y_{-q+1},\ldots,y_q]$, and $z=[z_{-q,-q+1},z_{-q,-q+2},\ldots z_{q-1,q}]$, then the elements $a_{ij}$(i,j=−q, −q+1, . . . , q) of the matrix A are given as $$a_{ij} = \sum_{\zeta\in G_b} y_i \text{ for } i=j, \text{ and } a_{ij} = \sum_{\zeta\in G_b} z_{ij} \text{ for } i\neq j$$

and the elements of $c_i$ of the vector c are given as $$c_i = \sum_{\zeta\in G_b} x_i.$$

Note that all summations are over the ζ included in set $G_b$. The solutions of the above system of linear equations is used to replace the tap vector b, for the next pass. Alternatively, we could use an update rule like $b_{new}=b_{old}+t.(b_{solution}-b_{old})$, where t lies between 0 and 1, and the meanings of the variables are obvious. Note that t=1 for the replacement update rule.

For every tap vector in the tap codebook there will be a similar system of equations, which when solved, yields the corresponding new tap vector. The updated codebook is used in the next pass of the training speech through the coder. The training speech is passed several times through the encoder for the tap codebooks to converge.

For the initial tap codebook design, the following procedure is followed. First a set of example tap vectors is generated by running a training speech file through the encoder. For each pitch lag (and corresponding ζ) in each subframe, we compute the tap vector b that maximizes $\zeta^T\beta$ by solving a system of equations of the form Ab=c, where the elements of A and c, derived from the ζ have similar form to that in the update rule, but with the summations replaced by single terms. That is, if $\zeta=[x\ y\ z]^T$, we know have $a_{ij}=y_i$ for i=j and $a_{ij}=z_{ij}$ for i≠j; and $c_i=x_i$. Among the solution b-vectors thus obtained, one for each pitch lag searched in a subframe, the one that gives the maximum value of $\zeta^T\beta$ is recorded as an example vector, and is also used to generate the excitation in the encoding process. Once the example vectors are at hand, they are used as the training set to design a simple Lloyd's codebook having as many codevectors as are desired in the resultant tap-codebook. This yields the initial codebook to be used in the update passes.

The technique described in the above paragraphs is easily adapted to design the primary and the secondary codebooks in an encoder employing tree-structured multitap adaptive codebook search according to a preferred embodiment of the invention. Here again we pass a training speech file through the coder repeatedly, until convergence. However, before the update passes can commence, we need to have the initial primary and secondary codebooks available. The initial primary codebook is designed by the process of single-level codebook design as outlined in the previous paragraph. Each codevector in the primary codebook is then split by small random perturbations into the required number of levels in secondary codebooks to generate the corresponding secondary codebook.

Given the initial primary and secondary codebooks, we run a speech training file through the coder repeatedly. In each pass, the set $G_b$ of ζ vectors that map onto a particular primary codevector is used to modify the same primary tap codevector as in the single-level update rule. Additionally, subsets of the set $G_b$ that map to individual secondary level codevectors, are used to modify the same secondary level vectors, again by the same update rule. At the end of each pass, we thus have a new primary codebook and a new set of secondary codebooks for the next pass. Several passes are made before the codebooks converge.

Now, turning from the discussion of the adaptive codebook search according to a first embodiment of the invention, the second embodiment of the invention pertains to the fixed codebook search. A fixed codebook search routine essentially strives to minimize the distortion $D=|v-He|^2$, where v is the target after the adaptive codebook contribution has been subtracted from the weighted speech, and e is the excitation. Normally the excitation is constrained to reduce the bit rate and the complexity of the search, in a manner such that the weighted synthetic speech still maintains reasonable match with the target. The family of ternary fixed codebook excitation schemes constrains the excitation so that some of the elements of the excitation vector are signed pulses, the rest all being zero. The excitation is associated with one or more gains. The search essentially consists of picking the right pulse locations and signs, followed by computing the gains(s).

In general, if any fixed codebook excitation vector has a single gain associated with it, it can be written as e=gf where g is a gain factor and f is the unscaled excitation shape, so that $D=|v-gHf|^2$. Minimizing D with respect to the gain g for a given fixed vector f yields, $$g=vTHf/|Hf|^2. \quad \text{(EQ 5)}$$

This value of g when substituted into the expression for D, gives $$D=|v|^2-(v^THf)^2/|Hf|^2 \quad \text{(EQ 6)}$$

Minimizing D for a fixed target v, therefore amounts to maximizing the metric $(v^THf)^2/|Hf|^2$ over all possible excitation shape vectors f, followed by choosing the gain g as in EQ 5. For a ternary excitation structure, performing an exhaustive joint search for all pulse positions to minimize D is computationally too expensive for some applications. In fact, for some applications, even a sequential search for pulse positions and signs can be computationally too expensive.

According to the second preferred embodiment of the invention, the new Backward and Inverse Filtered Target (BIFT) matching technique is a solution to the computational cost problem for such applications. The Backward and Inverse Filtered Target (BIFT) excitation search is a very low-complexity but high quality fixed excitation search routine. The following analysis pertains to the case when there is a single gain associated with a ternary excitation vector. In order to develop very low-complexity sub-optimal algorithms for ternary fixed codebook excitation, two approaches may be taken. The first approach, which will be referred to as the Backward Filtered Target approach, consists of neglecting variations in the energy term $|Hf|^2$ (the denominator) in the metric $(v^THf)^2/|Hf|^2$, and making the choice of pulse locations based solely on the magnitude of the correlation term $v^THf$. If we then define $c=H^Tv$ as the backward filtered target, and v consists of a fixed number of unit amplitude pulses, then choosing the best pulse locations amounts to choosing the magnitude peaks of the backward filtered vector c as the pulse locations. The signs of the pulses are the same as the signs of the corresponding elements of the c vector, e.g. could be positive or negative.

The second approach, which will be referred to as the Inverse Filtered Target approach aims at minimizing $D'=|v'-gf|^2$ instead of $|v-gHf|^2$, where v' is the inverse filtered target given by $v'=H^{-1}v$. The optimal gain g for a given excitation shape f, in this case, is given by $g=v'^Tf/|f|^2$, which when substituted in D' yields, $D'=|v|^2-(v'^Tf)^2/|f|^2$. Thus the metric that we must maximize in order to minimize D' is $(v'^Tf)^2/|f|^2$. Since the number of pulses to pick is fixed, and the elements corresponding to the chosen pulse locations in f have unit amplitudes, the rest all being zero, the denominator of this metric is a constant equal to the number of pulses. Thus, the metric reduces to maximizing $v'^Tf$. Here again, choosing the best pulse locations to maximize metric amounts to choosing the magnitude peaks of the inverse filtered target v'. The signs of the pulses are the same as the signs of the corresponding elements of the v' vector.

Figure 6:
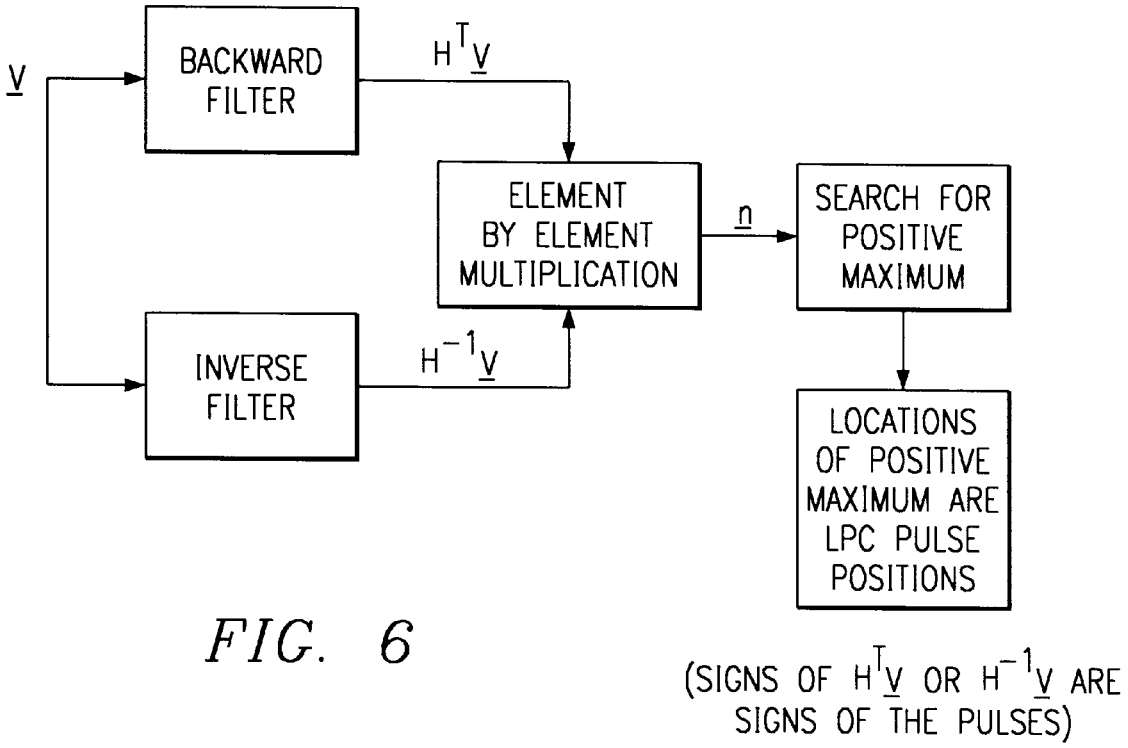
FIG. 6 shows the Backward Inverse Filtered target approach to determining the pulse positions of the fixed excitation according to a second embodiment of the invention.

According to the second preferred embodiment of the invention, BIFT effectively combines both of these sub-optimal approaches to do something that performs better than both, as shown in FIG. 6. First we must realize that both of these approaches strive to achieve, in some sense, the best match of the target with the excitation filtered through the weighted synthesis filter. However, while one uses the backward filtered target for peak-picking, the other uses the inverse filtered target for peak-picking, and both achieve their purpose to some extent. This indicates that there is a strong positive correlation between the ranking of the magnitudes of elements of c and v', at least at the locations where the amplitude of the elements in either vector is high. BIFT combines the elements of c and v' by element-by-element multiplication to define a new vector n. That is, the ith element of the vector n is given as, $n_i=c_iv'_i$, $i=0,1 \ldots, K_c-1$, where $K_c$ is the subframe dimension. Thus, the vector n can be regarded as the inverse filtered target vector weighted by the background filtered target. Then the algorithm picks a certain number of maximums of the new vector n, to choose the pulse locations. The signs assigned are the same as the signs of the corresponding elements of c and v'. Note that BIFT does not use absolute values of the elements of n for peak-picking, it only chooses the maximum numerical values. That is because, if a location is a good candidate for the excitation, the corresponding elements of c and v' vectors ought to have the same sign. In fact, if they do not, then the location is not likely to be a good candidate for the excitation. Once the pulse locations and the signs are chosen, the optimal gain is computed by (EQ 5), and then scalar quantized. Alternatively, we can do a joint quantization of the interpolated lags adaptive codebook gain and the BIFT gain, as in EFR1. The basic BIFT as described above will henceforth be referred to as BIFT1.

BIFT1 gives Segmental SNR values about 1 dB more than either of the two sub-optimal schemes, and in general achieves good performance at very low complexity. Two filtering operations require $K_c^2/2$ multiply-accumulates each, while the element-by-element multiplication requires $K_c$ additional multiplications. If the number of pulses to pick is N, in the worst case, approximately $NK_c$ comparisons are required, where we assume each comparison is equivalent to one addition. Thus the total number of multiply-accumulates is only $K_c^2+(N+1)K_c$. No correlations or energy computations are necessary.

In this section two variations of the BIFT will be described. The first enhances its performance, while the second reduces its complexity further. In the first variant, instead of associating a single gain with the pulses, we associate more than one gain. If the total number of pulses required is N, and the number of gains to associate them with is L, every N/L pulses are associated with a common gain. As we pick numeric peaks from the vector n, the largest N/L peaks are associated with the first gain, the next largest group of N/L peaks are associated with the second gain, and so on for L groups. For computing the gains the following joint optimization procedure is used:

In general, if an excitation has multiple gains associated with it, it is of the form: $e=g_1f_1+g_2f_2+\ldots+g_sf_s$, where s is the number of gains, and $f_k$'s are individual excitation shape vectors, associated with corresponding gains $g_k$. Alternatively, we can write e=Fg, where matrix $F=[f_1f_2 \ldots f_s]$, and vector $g=[g_1, g_2, \ldots g_s]^T$. With this notation, $D=|v-HFg|^2$. Minimizing D jointly with respect to elements of the gain vector g, for given matrix F, yields, $$g=[(HF)^T(HF)]^{-1}(HF)^Tv \quad \text{(EQ 7)}$$

This value of g, when substituted into the expression for D, gives $$D=|v|^2-(v^THF)[(HF)^T(HF)]^{-1}(HF)^Tv \quad \text{(EQ 8)}$$

Minimizing D for a target v, therefore amounts to maximizing the metric $(v^THF)[(HF)^T(HF)]^{-1}(HF)^Tv$ over all possible unscaled excitation shape vectors $f_k$'s, followed by choosing the gain vector g as in (EQ 7). We can use the above procedure to obtain gains in the above BIFT variation. Once the L sets of pulses, and the corresponding L excitation shapes are found, we can use (EQ 7) to obtain their gains jointly. The gains thus obtained are all scalar quantized in the log domain. The first gain is quantized as is, while the subsequent gains are coded differentially. This variant is referred to as BIFT2.

In the second variant, which aims at reducing the complexity of the fixed codebook search further, we divide the subframe of dimension $K_c$ up into several small sub-vectors and perform BIFT1 on each. The pulses in a sub-vector are associated with a common gain. Thus, there are as many gains as there are sub-vectors. If the total number of pulses required is N, and the subframe is divided into L sub-vectors of size $K_c/L$ each, there will be N/L pulses picked from each sub-vector. The successive BIFT1 operations on the sub-vectors proceed in a multi-stage fashion. For each stage after the excitation is searched, the gain is computed by (EQ 5) and quantized. The target is then updated for the subsequent stage by subtracting the overall response of the pulses (with quantized gain) in the current sub-vector, from the current target. Although the backward and inverse filtering operations need to be performed separately for each sub-vector, they are now of reduced dimensionality $K_c/L$, rather than the usual $K_c$, resulting in a decrease in complexity with a decrease in the sub-vector size. At some point, however, the overheads for the multistage operation become dominant, and reducing sub-vector sizes further actually increases complexity. The gain for each stage is obtained by (EQ 5) with v being the target vector for the stage. The gains are scalar quantized in the log-domain. The first stage gain is coded as is, and the subsequent stage gains are coded differentially. This algorithm is referred to as BIFT3. A variant of this algorithm does a joint quantization of the gains using (EQ 7) once the excitations have been determined. In this case, the unquantized gain is used to determine the updated target for the next stage.

Incorporation of two new features: namely, Multitap Tree-structured Adaptive Codebook Search, and the BIFT variants for fixed codebook excitation search in a CELP coder resulted in the development of a family of coders between 12 and 16 Kb/s. All produced very high segmental SNR values, and good quality coded speech, in spite of being very low complexity.

I claim:

1. The method of Tree-Searched Multitap Adaptive Codebook Excitation search to produce the best match with the input speech vector comprising the steps of:

a' providing an input speech vector;

a providing a plurality of primary tap codevectors in a primary tap codebook, wherein each primary tap codevector has an index;

b providing a plurality of pitch lags;

c selecting the pitch lag/primary tap codevector pair which produces the best match with the input speech vector;

d indicating a plurality of secondary tap codevectors in a secondary tap codebook by said index of said selected primary tap codevector of said selected pitch lag/primary tap codevector pair;

e selecting the pitch lag/secondary tap codevector pair which produces the best match with said input speech vector.

2. The method according to claim 1, wherein said secondary tap codebook becomes the new primary tap codebook and is used to develop a new secondary tap codebook, and said process is repeated a plurality of times.

3. The method according to claim 1, wherein said "c" and "d" steps are repeated a plurality of times.

4. The method according to claim 1 wherein said pitch lag has a range and further, wherein said range of pitch lags considered in the search is within an initial pitch estimate.

5. The method according to claim 1, wherein the search is performed in the residual domain.

6. The method according to claim 1, wherein the search is performed in the weighted speech domain.

7. The method according to claim 1, wherein said pitch lag defines a set of consecutive previous samples of processed speech.

8. The method of Tree-Searched Multitap Adaptive Codebook Excitation search to produce the best match with the input speech vector comprising the steps of:

a providing an input speech vector;

b multiplying each set of consecutive candidate vectors in an ordered codebook by each set of primary candidate scale factors taken from a primary tap codebook yielding a set of primary resulting vectors;

c adding the primary resulting vectors to yield a candidate primary output vector;

d computing the error between said input speech vector and said candidate primary output vector;

e selecting a set of candidate vectors and primary scale factors which minimizes said error;

f indicating a plurality of secondary scale factors in a secondary tap codebook by said selected primary scale factors;

g multiplying each set of consecutive candidate vectors in an ordered codebook by each set of said secondary scale factors taken from said secondary tap codebook, yielding secondary resulting vectors;

h adding the secondary resulting vectors to yield a candidate secondary output vector;

i computing the error between said input speech vector and said candidate secondary output vector;

j selecting the set of candidate vectors and secondary scale factors which minimizes said error.

9. The method according to claim 8, wherein said secondary tap codebook becomes the new primary tap codebook and is used to develop a new secondary tap codebook, and said process is repeated a plurality of times.

10. The method according to claim 8, wherein said steps "e", "f", "g", "h" and "i" are repeated a plurality of times.

11. The method according to claim 8, wherein said ordered codebook is an adaptive codebook.

12. The method according to claim 8, wherein said sets of consecutive candidate vectors has a range and further, wherein said range of consecutive candidate vectors considered in the search is within an initial consecutive candidate vector estimate.

13. The method according to claim 8, wherein the error is computed in the residual domain.

14. The method according to claim 8, wherein the error is computed in the weighted speech domain.

15. The method according to claim 8, wherein said set of consecutive candidate vectors define a set of previous samples of processed speech.

16. The method of developing very low-complexity algorithms for ternary fixed codebook excitation search comprising the steps of:

providing an input speech vector;

calculating a backward filtered vector by pre-multiplying said input speech vector by the transpose of an impulse response matrix;

calculating an inverse filtered vector by pre-multiplying said input speech vector by the inverse of an impulse response matrix;

multiplying each element-of said backward filtered target vector to each corresponding element of said inverse filtered target vector thereby defining a new vector;

choosing pulse locations by choosing a predetermined number of maximums of said new vector, wherein the signs corresponding to said maximums are the same as the signs of the corresponding elements of said backward filtered target and inverse filtered target vectors.

17. The method according to claim 16, further comprising the step of:

computing and scalar-quantizing an overall optimal gain.

18. The method according to claim 16, further comprising the step of:

grouping said pulse locations into a plurality of sets of pulse locations, and computing and quantizing a separate gain value for each set of pulse locations.

* * * * *

UNITED STATES PATENT AND TRADEMARK OFFICE

CERTIFICATE OF CORRECTION

PATENT NO. : 6,161,086
DATED : December 12, 2000
INVENTOR(S) : Mukherjee et al.

It is certified that error appears in the above-identified patent and that said Letters Patent is hereby corrected as shown below:

Title page, item [54],
Column 1,
Should read, -- "LOW-COMPLEXITY SPEECH CODING WITH BACKWARD AND INVERSE FILTERED TARGET MATCHING AND A TREE STRUCTURED MULTITAP ADAPTIVE CODEBOOK SEARCH" --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*